United States Patent [19]

Rouse et al.

[11] Patent Number: 4,806,056

[45] Date of Patent: Feb. 21, 1989

[54] MODULAR FUEL METERING APPARATUS AND METHOD FOR USE THEREOF

[75] Inventors: Michael W. Rouse, West Linn; Robert L. Thelen, Woodburn, both of Oreg.

[73] Assignee: Waste Recovery, Inc., Dallas, Tex.

[21] Appl. No.: 882,603

[22] Filed: Jul. 7, 1986

[51] Int. Cl.[4] ..... F23K 3/14

[52] U.S. Cl. ..... 414/160; 406/57; 414/159; 414/190

[58] Field of Search ..... 414/152, 158, 160, 173, 414/187, 190, 154, 163; 432/239; 406/57

[56] References Cited

U.S. PATENT DOCUMENTS

| | | | |
|---|---|---|---|
| 245,427 | 8/1881 | Averell | 406/57 X |
| 1,496,913 | 6/1924 | Warford | 406/57 X |
| 2,178,360 | 10/1939 | Kohout | 414/190 |
| 2,507,254 | 5/1950 | Dady | 414/190 X |
| 3,939,297 | 2/1976 | Aylard | 414/187 X |
| 4,102,278 | 7/1978 | McManama | 414/160 X |
| 4,577,564 | 3/1986 | Tomita | 414/158 X |
| 4,631,026 | 12/1986 | McKinney | 414/158 X |

FOREIGN PATENT DOCUMENTS

| | | | |
|---|---|---|---|
| 191683 | 9/1964 | Sweden | 414/152 |

*Primary Examiner*—Peter R. Brown

*Attorney, Agent, or Firm*—Chernoff, Vilhauer, McClung & Stenzel

[57] ABSTRACT

Apparatus and a method for delivering materials such as comminuted rubber tires as a secondary fuel to a combustion chamber of a furnace or kiln. A hopper includes a variable speed electric motor-driven screw conveyor, and a control system provides a variable frequency alternating current to the motor of the screw conveyor to deliver a metered amount of fuel from the hopper. A blower and a nozzle assembly may be used to entrain the fuel in a stream of air and carry the fuel to the combustion chamber where it is required. The fuel is delivered in metered quantities in response to the required firing rate of the furnace or kiln. A second metering device provides metered quantities of material which can be carried by the fuel to be taken into a high temperature environment to be decomposed or burned. The apparatus is mounted on a transportable platform.

1 Claim, 3 Drawing Sheets

MODULAR FUEL METERING APPARATUS AND METHOD FOR USE THEREOF

BACKGROUND OF THE INVENTION

The present invention relates to improvements in delivery of fuel for combustion in kilns, boilers, and other applications where a controlled firing rate is used.

It has long been the practice to discard used tires as landfill, while only a relatively small portion of the available materials are reused. A great deal of recoverable chemical energy is therefore available for use by burning used pneumatic tires from motor vehicles, but such an energy source has not been recognized as it should be.

The combustion fuel value of scrap tires is relatively consistent for a given weight of material available to be burned. The toughness of tire material, however, particularly from fiber and wire-reinforced tires, has long made it difficult to use tires effectively as fuel. Machines are now available, however, which are capable of economically shredding tires into pieces small enough to be used efficiently as fuel in some applications.

For example, boiler furnaces which conventionally have burned chipped waste wood and bark known as hog fuel can readily accommodate shredded tires as a part of their fuel. In other applications, however, the conventional fuel, such oil, gas, or coal dust, is much more easily burned than has previously been possible with shredded tires, which will hereinafter at times be called tire-derived fuel. Previously there has been no available way to supply tire-derived fuel in well-controlled quantities to the combustion zone of a furnace or kiln to provide controllable amounts of thermal energy as a result of combustion.

Nevertheless, it is desirable in many applications to supplement or replace conventional oil, gas, or coal fuels by tire-derived fuel because of the savings which may be effected in the total fuel costs of operation.

As has been taught in Pennell U.S. Pat. No. 4,081,285 and Watson et al. U.S. Pat. No. 4,022,630, such devices as cement kilns can be fired effectively using low quality fuel such as household waste materials as a significant portion of the total mixture of fuels used, without the ash from such materials diminishing the quality of the cement produced thereby. This has been mentioned, as well, in the November 1983 issue of *World Wastes* magazine in an article entitled "Company Uses Refuse To Fuel Cement Works." Cement kilns and lime kilns can similarly utilize tire-derived fuel if it can be delivered to the combustion zones within such kilns conveniently and controllably. However, relatively inexpensive apparatus has not previously been available to enable the economical use of tire-derived fuel in such applications.

Besides tires, there are other wastes which are difficult to eliminate because of their toxicity and difficulty in handling them safely. Some organic chemical compounds cannot safely be dumped in landfills because of their carcinogenic properties, but can be rendered harmless by being exposed to high enough temperatures for a long enough time. Such temperatures and times are available in lime kilns and cement kilns, but the usual sludge form in which such chemical wastes are usually found cannot be dealt with efficiently using previously available technology.

What is needed, then, is apparatus and a method for measuring and delivering shredded tires and other comminuted refuse as fuel, particularly as a secondary fuel in applications where more expensive oil, gas, or coal is normally the primary source of chemical heat energy, and a way to burn chemical waste sludge to convert it to safe waste.

SUMMARY OF THE INVENTION

The present invention provides apparatus and a method for using materials such as variously-sized pieces, including coarse pieces of pneumatic tire casings and containing various amounts of reinforcing fiber materials and steel wire, as combustion fuel, and thus concurrently meets the need for a way to dispose of worn-out tire casings and other resilient, tough organic waste materials and to recover useful energy from combustion of such materials economically and conveniently. These fuel materials are used, in one aspect of the invention, as a vehicle for carrying chemical wastes to a high temperature zone for thermal decomposition and disposal of such chemical wastes.

According to the present invention a metering and delivery unit for tire-derived fuel includes a hopper of adequate size to contain a large enough supply of tire-derived fuel for a reasonably long period, such as a shift. The metering unit may be portable in order to permit demonstration of the use of tire-derived fuel as a secondary source of heat energy in applications such as lime kilns, cement kilns, boiler furnaces, and the like. Preferably such a fuel metering and delivery unit is constructed on a supporting frame including skids or wheels on which a suitably large hopper is constructed. The hopper includes a bottom having sloping sides which deliver tire-derived fuel under the influence of gravity to a metering screw conveyor driven at a variably controlled speed. In a preferred embodiment of the invention an electric motor is used, and the speed of the metering conveyor is controlled by the variable frequency of an alternating electric current provided by a power supply which converts normal three phase 60 Hz line current to a variable output frequency within the range of 0 to 120 Hz, used to operate the motor connected to the metering screw conveyor. In response to variations in the frequency provided by the power supply, the speed of the metering screw varies to deliver tire-derived fuel at a controlled rate. The fuel can be transported further by various means, to be introduced into the combustion chamber of a boiler furnace, lime kiln, cement kiln or other similar burner applications where combustion is carried on at a high enough rate to accept and provide for complete combustion of low quality fuels. For example, an endless belt or chain-and-bucket or screw conveyor may be used to deliver tire-derived fuel to a solid fuel-burning device.

For delivery of tire-derived fuel for use in cement kilns and lime kilns, it is preferred to deliver the fuel pneumatically through a large pipe, or fuel delivery conduit. The size of the pipe must be adequate to permit passage of the pieces of tire-derived fuel without being clogged. Since the tire-derived fuel often includes small particles which might become wind-borne, it is necessary to introduce the tire-derived fuel into such a pneumatic system in a way which will not result in small pieces of the fuel being blown back into the atmosphere. This introduction of the tire-derived fuel into a pneumatic delivery system can be accomplished in various ways. The preferred manner, according to the present invention, however, is the use either of a triple gate valve, for example one of the type disclosed in U.S. Pat. No. 4,561,467, or the use of venturi-type nozzle assembly, which forms a part of the present invention.

In pneumatic delivery of tire-derived fuel, a blower, which may be electrically powered, may be mounted on the base which supports the tire-derived fuel supply hopper, and an exhaust pipe from the blower is connected to a nozzle which restricts and accelerates the flow of air, creating a low pressure area surrounding the discharge end of the nozzle. An appropriate shroud surrounds the nozzle and includes an infeed opening through which tire-derived fuel is introduced into the zone of low pressure surrounding the exhaust end of the nozzle. The flow of air entrains the tire-derived fuel, carrying it into the delivery conduit for delivery to the cement kiln, lime kiln, or other combustion chamber. The location of the discharge end of the nozzle and the shape of the nozzle are adjustable in a preferred embodiment of the invention, so that an optimum flow of tire-derived fuel can be developed and maintained, particularly in a fuel supply and metering unit which is likely to be used in various different applications at different times. This enables the flow of air through the nozzle to be controlled to provide the best delivery of fuel within the range of volumes of fuel which is appropriate to the particular application, and considering the length of fuel delivery conduit through which the fuel must be blown. This is accomplished in one embodiment of the invention by using a nozzle having a rectangular exit opening, with the separation between converging opposite sides of the nozzle being adjustably variable, and by having the nozzle slidable within the exhaust pipe from the blower.

Preferably, the discharge end of the fuel delivery conduit is adjusted to deliver a dispersed discharge flow of air and tire-derived fuel into the area of flame of combustion of the oil, gas, coal, or other primary fuel. Additionally, smaller amounts of such materials as certain hazardous waste sludges which are rendered harmless by long enough exposure to high enough temperatures can be metered by similar apparatus to mix with and coat surfaces of the tire-derived fuel after it has been metered, so that the hazardous or difficult-to-dispose-of materials can be fed pneumatically into a cement kiln to be disposed of safely.

The modular fuel metering and delivery system of the invention preferably includes remotely readable indicators and is remotely controllable to vary the rate of delivery of fuel. It can also be adjusted to provide a steady flow of fuel while the firing rate of the furnace or kiln is controlled by varying the primary fuel supply.

It is therefore a principal object of the present invention to provide improved apparatus and a method for useful disposal of solid combustible materials such as shredded rubber tire cases as combustion fuel, and also to dispose safely of certain hazardous wastes in solid, wet, solvent-contaminated form.

It is another important object of the present invention to provide a portable modular fuel metering and delivery apparatus for demonstrating the utility of adding to an existing fuel burner the capability of burning alternative solid fuels such as shredded pneumatic tire casings to supplement more expensive conventional fuels in certain applications.

It is an important feature of the present invention that it provides a fuel storage hopper equipped with a screw-type fuel-metering conveyor driven by a variable speed motor controlled in response to the requirements for combustion of fuel.

It is another important feature of the present invention that it provides apparatus for delivering solid fuel pneumatically, in which an eductor nozzle assembly receives and entrains a flow of lumpy and particulate solid fuel in a stream of air and delivers the fuel and air to a remotely located combustion zone where the fuel is to be used.

It is a further important feature of the present invention that it provides apparatus and a method for introducing hazardous chemical wastes into a detoxifying environment.

It is yet a further feature of the present invention that it provides a method for supplementing a conventional fuel supply with a metered flow of comminuted combustible solid waste materials and thereby usefully disposing of waste tires and the like.

It is also a further feature of the present invention that it provides a control system to provide supplemental fuel in required quantities to maintain a variable firing rate in a boiler furnace, kiln, or other similar application.

It is another advantage of the present invention that it provides an improved method for delivery of particulate tire-derived fuel to a combustion chamber.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
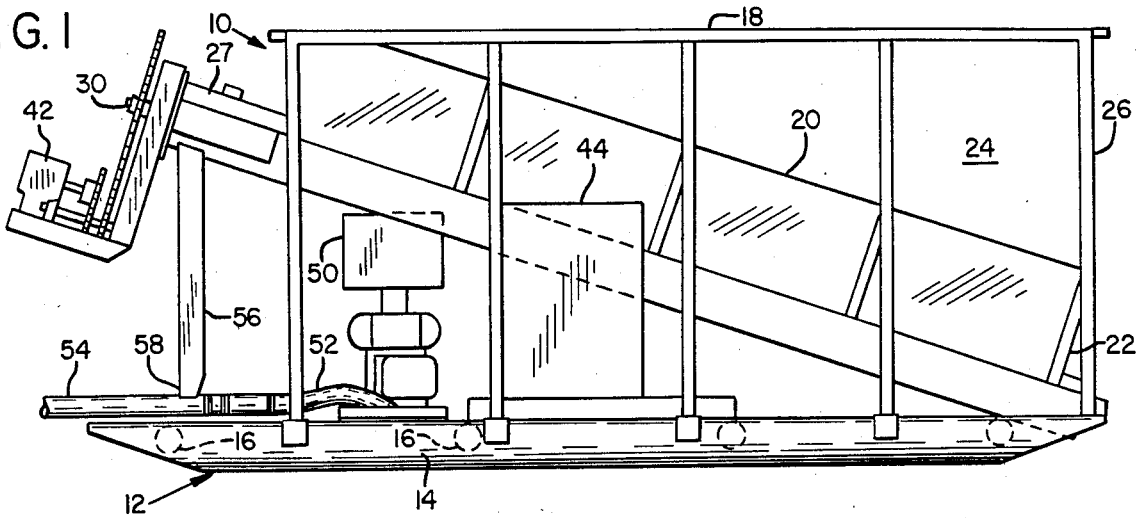
FIG. 1 a side elevational view of an exemplary portable modular fuel metering and delivery apparatus embodying the present invention.
Figure 2:
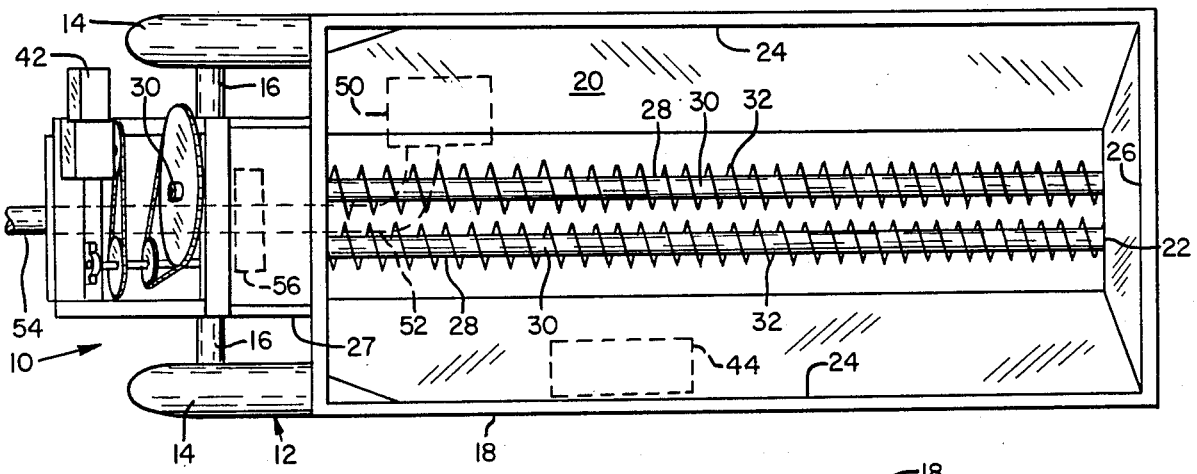
FIG. 2 is a top plan view of the apparatus shown in FIG. 1.
Figure 3:
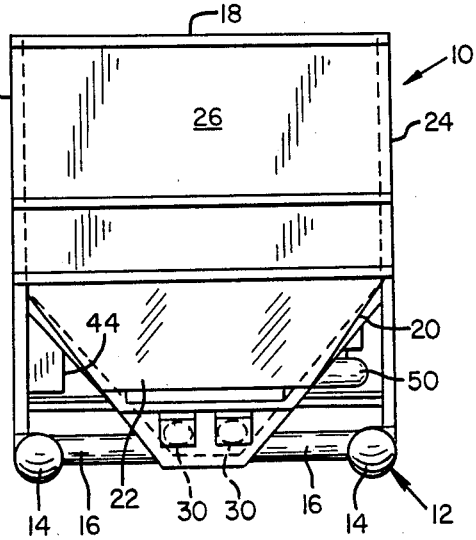
FIG. 3 is an end elevational view of the apparatus shown in FIG. 1.

Referring now to the drawings, an exemplary modular fuel metering unit 10, shown in FIGS. 1–3, includes a supporting base frame 12 including a pair of elongate, parallel, spaced-apart skid members 14 interconnected by transverse members 16. Supported atop the base frame 12 is a hopper 18 having an upwardly open "v"-shaped bottom trough portion 20 which is sloped upwardly from a tail end 22. Vertical parallel side portions 24 and a vertical end wall 26 extend upwardly above the "v"-shaped trough 20.

Figure 4:
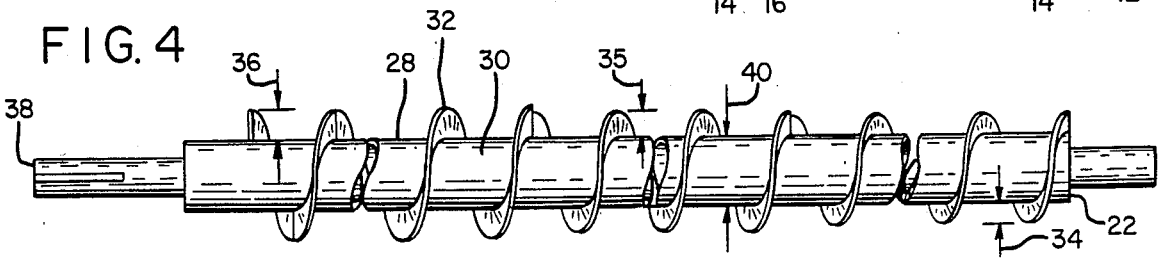
FIG. 4 is a side elevational view of an exemplary fuel metering conveyor screw of a type appropriate for use in the apparatus shown in FIG. 1.

Extending along the bottom of the "v"-shaped trough 20 is a fuel feed metering conveyor 27, comprising a pair of metering screws 28 each having an elongate central shaft 30 and a helical screw flight 32 extending radially outwardly from the shaft 30. As is shown more clearly in FIG. 4, the radial dimension of the helical screw flight 32 has a uniform pitch and a graduated diameter, ranging from a minimum radial depth 34 of 2 inches, adjacent the tail end 22, through a radial depth 35 of 2½ inches in a middle portion, to a maximum radial depth 36 of 3 inches adjacent the outfeed end 38. Each central shaft 30, which may be hollow over the length of the helical screw flight 32, may have a diameter 40 of 6 inches over the entire length of the helical screw flight 32. The tapered shape of the metering screws is intended to prevent the materials being metered from being piled up toward the outfeed end 38 as the hopper 18 is emptied. Alternatively, the helical screw flight 32 could be of uniform diameter, with a pitch varying from a minimum at the tail end 22 to a maximum pitch at the outfeed end 38, for the same purpose.

A motor 42 in a preferred embodiment of the invention is an alternating current electric motor whose speed is controlled by the frequency of alternation of the electrical current. The motor 42 is connected, through a reduction gear and appropriate speed reducing pulley and belt drive connections, to turn the central shafts 30 of the metering screws 28 at a speed directly proportional to the frequency of the alternating current supplied to the motor 42.

Figure 5:
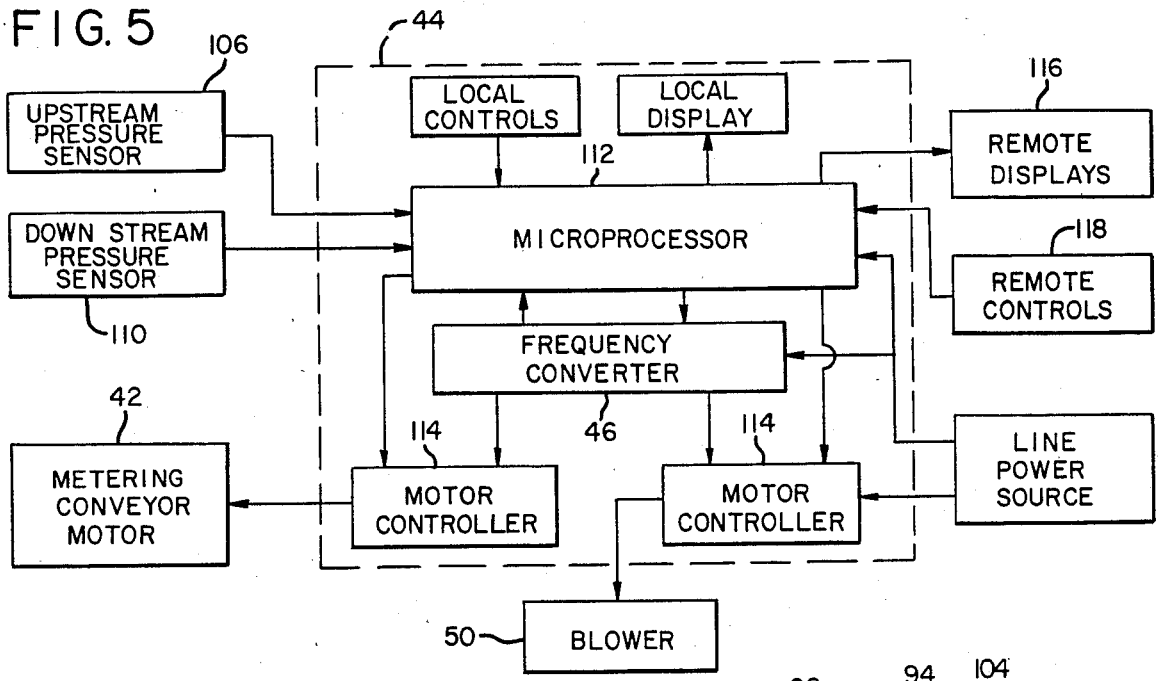
FIG. 5 is a block diagram illustrating the manner of controlling the fuel metering apparatus shown in FIG. 1.

A feed metering conveyor controller 44 mounted on the base frame 12 adjacent the hopper 18 is supplied with available line alternating current, for example, 450-volt AC, 60-Hz three-phase line current from a commercial source. The feed metering conveyor controller 44 includes a frequency converter 46 (FIG. 5), which provides an output of alternating current connected to the motor 42 with the output frequency variable from 0 to 120 Hz. The controller 44 includes electrical circuitry which does not form a portion of the present invention, but may, preferably, be controlled by computer input, in order to control the speed of rotation of the shafts 30 and thus control the rate of delivery of material as a result of the operation of the metering screws 28. FIG. 5 depicts schematically one possible control circuit arrangement, which will be described in greater detail subsequently.

The metering unit 10 is intended to be used to meter fuel such as comminuted pneumatic tire material, referred to as tire-derived fuel 48, at a controlled rate, for delivery from the metering unit 10 to the combustion chamber of a furnace or to the combustion zone of a lime kiln or cement kiln. The metering unit 10 may also be used in other applications where fuel is of a particulate or lumpy nature including pieces having a wide range of sizes, such as the range from dust and sand- or gravel-sized pieces of tire-derived fuel 48 up to irregular pieces of such fuel having a maximum dimension of two inches or more.

It has been found that in the case of such fuel material as comminuted tire casings, the pieces of tire-derived fuel 48 may be transported pneumatically over the distances usually encountered in industrial applications where the modular metering unit 10 of the present invention may be most useful. Therefore, a blower 50 is associated with the apparatus 10, preferably being supported on the base frame 12. The blower 50 provides a high-volume flow of air through an exhaust pipe 52 leading to a fuel delivery conduit 54. Tire-derived fuel 48 is introduced into the fuel delivery conduit 54 through a connecting infeed conduit 56 extending from the metering screw conveyor 27 to the fuel delivery conduit 54 through a tee junction 58 located on the base frame 12 beneath the outfeed end of the metering screw conveyor 27.

Figure 6:
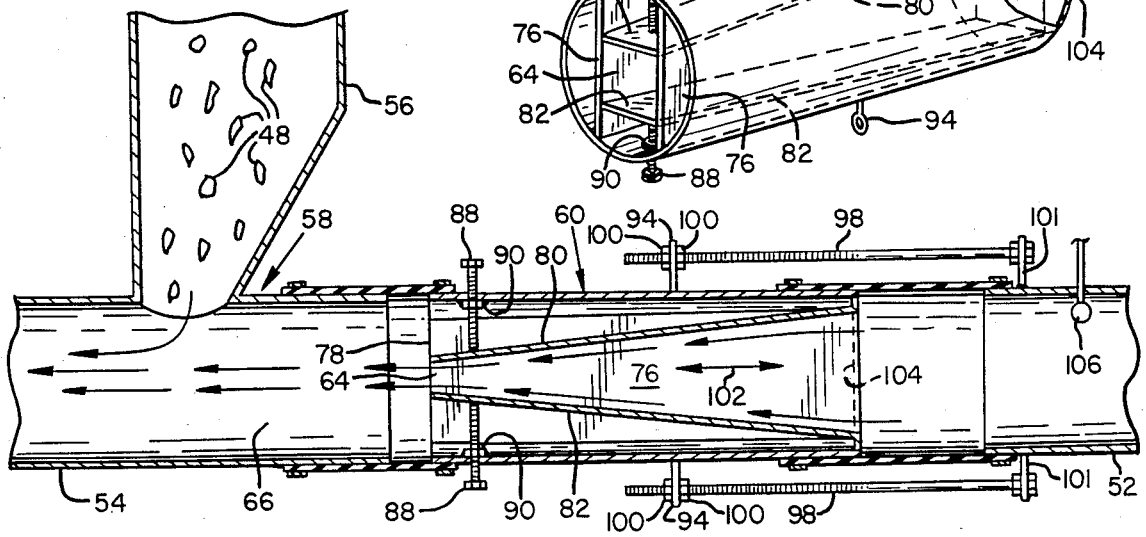
FIG. 6 is a sectional elevational view of a tee junction and a nozzle assembly which may be used with the apparatus shown in FIG. 1 for introducing solid particulate fuel into a pneumatic fuel delivery conduit.
Figure 7:
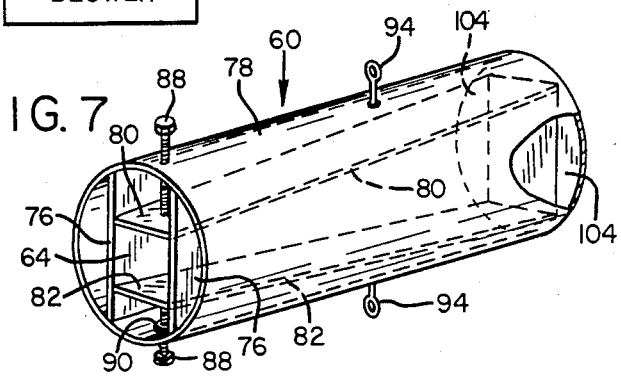
FIG. 7 is a perspective view of a nozzle portion of the nozzle assembly shown in FIG. 6.

Included in the tee junction 58 is a nozzle assembly, shown in greater detail in FIGS. 6 and 7, including a tapered nozzle 60 having a throat 62 reducing the area and increasing the velocity of flow of air received into the nozzle 60 from the blower exhaust pipe 52. The exit mouth 64 of the nozzle is located in the tee junction 58 so as to provide a zone 66 of relatively low pressure at the lower end of the fuel infeed conduit 56. The high velocity stream of air leaving the exit mouth 64 of the nozzle 60 proceeds thence into the fuel delivery conduit 54, taking along with it the comminuted tire-derived fuel materials delivered from the hopper 18 at the rate determined by the metering conveyor controller 44.

Figure 8:
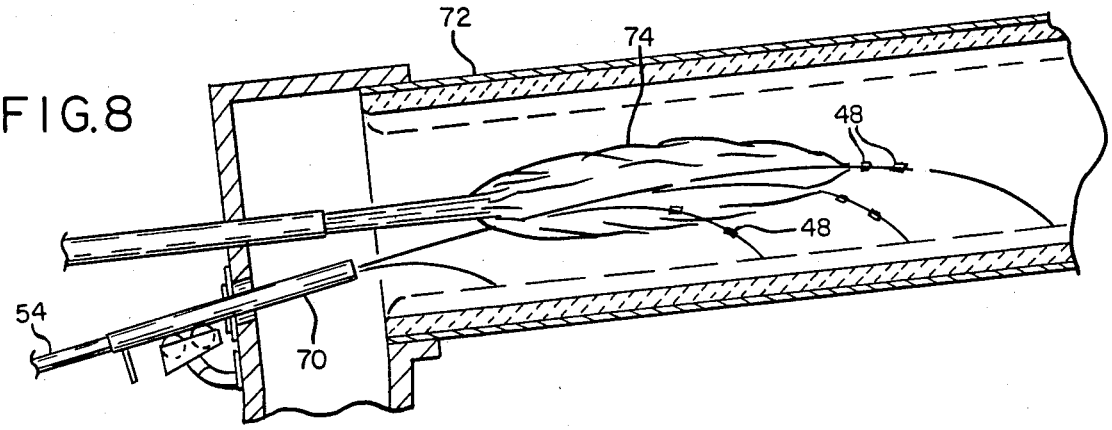
FIG. 8 is a simplified side view showing a preferred arrangement for pneumatic delivery of particulate fuel into a combustion zone in a lime kiln.

In one preferred application for the present invention, as shown in FIG. 8, the stream of air and tire-derived fuel carried along in the stream of air from the blower 50 proceeds by way of a fuel injection nozzle 70 and is discharged into the combustion chamber of a lime kiln 72. Preferably, the fuel injection nozzle 70 is adjustably located and aimed so as to distribute the tire-derived fuel pieces into the flame area 74, where oil, coal dust, or gas fuel of the primary fuel supply is being burned.

As shown in FIGS. 6 and 7, the nozzle assembly 60 located at the tee junction 58 includes a pair of parallel walls 76 fixedly located within a section of tubing 78 which fits slidably within the tee junction 58. The tubing 78 is long enough to provide room for a gradual taper between a pair of oppositely located converging plates 80 and 82 each having a rear end flexibly supported at the inlet end 86 of the tubing 78. A pair of adjustment screws 88 are supported in threaded engagement with respective nuts 90 fixedly attached to portions of the tubing 78.

Additionally, eye bolts 94, fixedly attached to the tubing 78, extend outwardly and a pair of adjustment screws 98, provided with adjustment nuts 100, are connected with respective anchoring devices 101 fixedly located on the outside of the exhaust pipe 52. Adjustment of the adjustment nuts 100 along the adjustment screws 98 changes the location of the tubing 78 within the exhaust pipe 52, as indicated by the double headed arrow 102. A short length of hose 103 is clamped over the tubing 78 and the exhaust pipe 52 to force air from the blower 50 through the nozzle 70.

The adjustment screws 88, pressing against the downstream ends of the converging plates 80 and 82, control the area of the exit mouth 64 and the angle of convergence of the converging plates 80 and 82, which fit slidingly and snugly between the parallel walls 76 within the tubing 78. Blanking plates 104 are provided on the rear end 84 of the tubing 78 to require air to flow through the convergent nozzle 60 defined by the parallel walls 76 and converging plates 80 and 82.

An upstream pressure sensor 106 is provided in the exhaust pipe 52 to determine the pressure provided by the blower 50 in the exhaust pipe 52 upstream of the nozzle 60.

Airflow under pressure provided by the blower 50 is accelerated to a greater speed within the nozzle 60, creating the zone 66 of low pressure downstream from the nozzle 60, at the lower end of the infeed conduit 56, and tire-derived fuel 48, along with an influx of air moving downwardly through the infeed conduit 56 toward the low pressure zone 66 under the influence of normal atmospheric pressure, is entrained with the flow of air exiting from the nozzle 60. The entire stream of air provided by the blower 50, together with air and tire-derived fuel 48 entering the fuel delivery conduit 54 by way of the tee junction 58, is carried through the fuel delivery conduit 54 toward its downstream end, for ultimate delivery into the combustion zone of a kiln or boiler furnace. Under normal conditions, once this flow has been established and the rate of delivery of the tire-derived fuel has been adjusted, the flow of tire-derived fuel will proceed steadily through the fuel delivery conduit 54. However, in order to detect an interruption or blockage of the flow of tire-derived fuel which might be difficult to clear from the fuel delivery conduit, a flow sensor, which may take the form of a second pressure sensor 110, is provided in a downstream portion of the fuel delivery conduit 54, for example, in a location near the outlet of the conduit 54. The pressure sensor 110 can detect a change of pressure within the fuel delivery conduit indicative of an abnormal condition.

Referring now particularly to FIG. 5, the metering conveyor controller 44 may include a microprocessor 112 suitably programmed and equipped to accept instructions from an operator to commence or cease operation of the modular fuel metering unit 10, and to increase or decrease the speed of the metering conveyor 27. The microprocessor 112 is connected controllingly to the frequency converter 46, which provides power through one or more motor controllers 114 connected, respectively, to the metering conveyor motor 42, and optionally to the motor of the blower 50. The pressure sensors 106 and 110 are connected electrically to provide indications of the pressure sensed to the microprocessor 112, which is programmed appropriately to shut down the motor 42 and the blower 50 in response to changes in pressure indicating a malfunction in the delivery of material from the hopper 18.

In order to avoid increased labor costs resulting from the use of the modular metering unit 10, the metering feed conveyor controller 44 provides electrical outputs to remote displays 116, which may be located, for example, in the control room of an industrial plant where the modular metering unit 10 is in use to show the pressures sensed by the sensors 106 and 110, and to show the output frequency of the frequency converter, or an equivalent fuel delivery rate. Similarly, remote controls 118 are connected electrically to the metering fuel conveyor controller 44 to enable an operator in such a remote location to start, stop, and adjust the speed of the metering conveyor 27.

Depending on the location where the modular fuel metering unit 10 is used, it is possible that the rate of delivery of material from the hopper 18 may be manually controlled, either locally or remotely, in response to demand, such as the demand for steam from a boiler or the change of temperature in a kiln, but in most locations where the primary fuel supply system has already been equipped with controls set to maintain a desired firing rate automatically, it will probably be simpler to adjust the rate of delivery of fuel from the hopper 18 to a predetermined value, generally a minority of the amount of fuel needed to operate the kiln or a boiler furnace. The automatic fuel control system associated with the primary fuel source will then provide the necessary amount of variation of firing rate in the normal manner.

Figure 9:
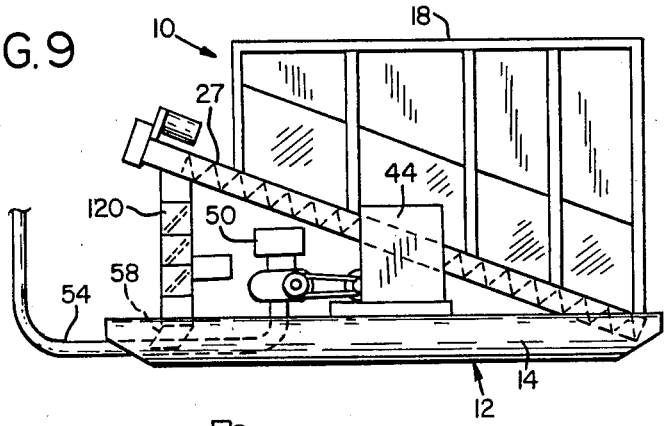
FIG. 9 is a view of an apparatus similar to that shown in FIG. 1, together with a triple gate valve assembly useful for introducing fuel into a pneumatic fuel delivery conduit in accordance with the invention.

Use of the tee junction 58 including the nozzle 60 to entrain material delivered by the metering feed conveyor 27 will normally be adequate to prevent dust from being dispersed into the air surrounding the modular fuel metering unit 10. In some applications it may be desirable, nevertheless, to include a triple gate valve 120 which provides a positive control against back pressure while permitting materials to be injected into the stream of air from the blower for delivery to a furnace or kiln. One such triple gate valve which has been found to be adequate for use in injecting lumpy fuel such as tire-derived fuel is disclosed in Rouse et al. U.S. Pat. No. 4,561,467, the disclosure of which is hereby incorporated herein by reference (see FIG. 9.)

Figure 10:
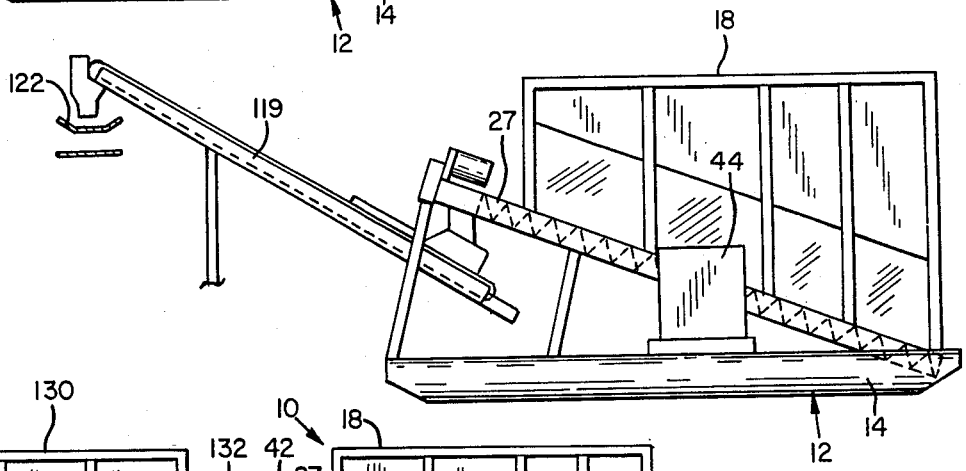
FIG. 10 is a view of an apparatus similar to that of FIG. 1, showing an arrangement utilizing a belt conveyor to deliver metered amounts of tire-derived fuel.

The modular fuel metering unit 10 of the present invention is also useful in metering fuel for delivery at a uniform rate by endless belt or chain conveyors, as shown in FIG. 10, where a screw conveyor 119 receives metered amounts of fuel from the fuel metering conveyor 27 and delivers it to an appropriate fuel feed conveyor 122 leading, for example, to the furnace of a hog fuel-fired boiler (not shown).

Figure 11:
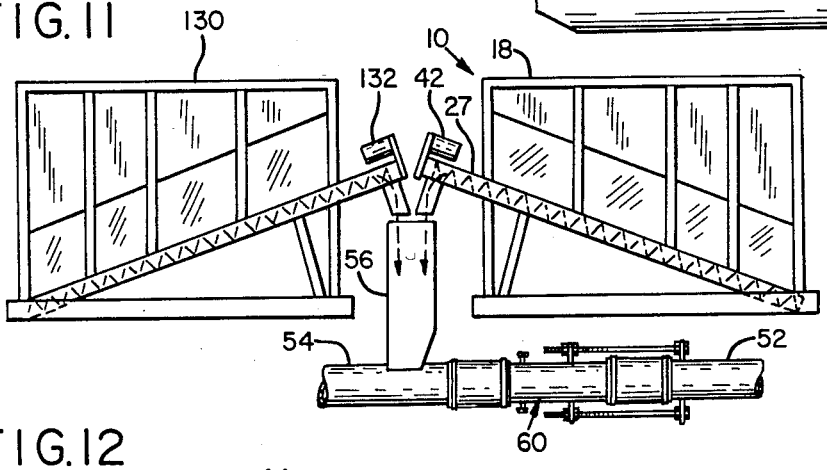
FIG. 11 is a partially schematic view of the apparatus according to the invention for use in disposal of chemical wastes in conjunction with use of fuel derived from solid wastes.

In order to dispose of some hazardous chemical wastes safely it is necessary to expose them to sufficiently high temperatures for long enough periods of time. The temperatures and time for materials to pass through a cement kiln or lime kiln are sufficient to result in decomposition and chemical reaction of resulting compounds to render many hazardous wastes safe, but it has previously been difficult to get such chemical wastes into such a location. As shown in FIG. 11, where tire-derived fuel is metered by a fuel metering unit 10 as described previously and supplied to a pneumatic fuel delivery system, a hazardous material metering unit 130 is provided which is capable of safely containing a quantity of the waste material to be eliminated. The chemical waste may, as is known, be in the form of a sludge, a liquid, or a slurry. The metering unit 130 is driven by an electric motor 132 controlled by the feed conveyor controller 44 and provides a flow of the hazardous material at a relatively small rate which is delivered to the infeed conduit 56 where it mixes with and is permitted to adhere to the surfaces of the pieces of tire-derived fuel 48 delivered by the metering conveyor 27. The tire-derived fuel, being pneumatically delivered to a lime kiln 72, carries the hazardous waste material along so that it is then exposed to the temperatures in the kiln 72 for a long enough time to render it safe for inclusion in the lime or cement produced. For example, in the case of dioxins, a temperature of 2000° F. sustained for 2 seconds is sufficient. In a cement kiln temperatures of 3000° F. are encountered for periods of 1 minute or longer, clearly providing the necessary conditions.

Figure 12:
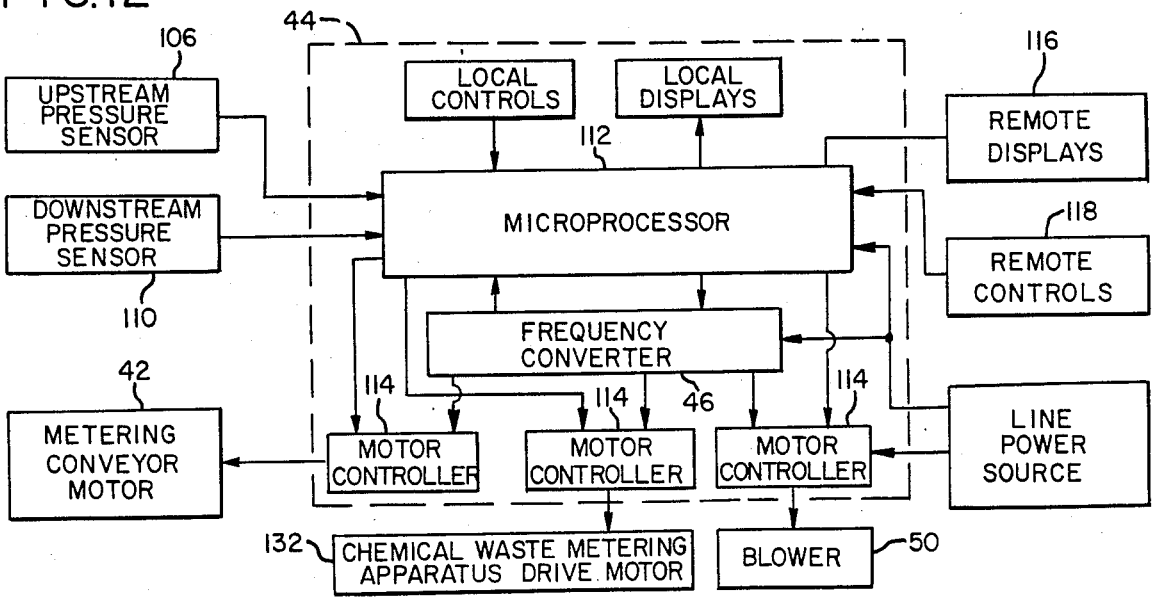
FIG. 12 is a partial block diagram showing a control system appropriate for use with the apparatus of FIG. 11.

Preferably, the metering unit 130 is connected to be controlled by the metering unit controller 44, as shown in FIG. 12, so that the microprocessor 112 will stop the motor 132 in response to small variations from normal conditions as monitored by the pressure sensors 106 and 110 and other sensors (not shown) which may be used, so that the metering unit 130 will be shut down first and hazardous material can be delivered to the kiln before the blower 50 and the metering conveyor 27 are shut down.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A portable modular apparatus for metering and delivering combustion fuel in the form of pieces of various sizes no greater than a predetermined maximum, at a predetermined rate, the apparatus comprising:

(a) a base, said base including skid means for supporting said apparatus movably;

(b) hopper means mounted on said base for containing a supply of said combustion fuel;

(c) a feed metering conveyor located in said hopper means;

(d) a feed metering conveyor controller supported on said base;

(e) variable speed motor means connected electrically with and responsive to said feed metering conveyor controller and connected drivingly with said feed metering conveyor for driving said feed metering conveyor at a speed controllably variable during operation;

(f) delivery means for receiving said fuel from said feed metering conveyor and delivering said fuel to a combustion chamber, said delivery means including a pneumatic fuel transport conduit and blower means connected to said fuel transport conduit for providing a fuel-transporting flow of air through said fuel transport conduit, and infeed means for introducing said fuel into said fuel transport conduit in amounts delivered by said feed metering conveyor, wherein said infeed means includes nozzle assembly means for controlling the flow of air in said fuel transport conduit so as to entrain said fuel and carry said fuel in a flow of air through said fuel transport conduit; and (g) an inclined bottom channel included in said hopper means, said feed metering conveyor being located along said bottom channel and driven by said variable speed motor means so as to move said combustion fuel upwardly along said inclined bottom channel to said delivery means.

* * * * *